US005847323A

United States Patent [19]

Murray et al.

[11] Patent Number: 5,847,323

[45] Date of Patent: Dec. 8, 1998

[54] HIGH CONDUCTANCE SURGE CABLE

[75] Inventors: Matthew M. Murray, Espanola, N. Mex.; Dennis H. Wilfong, Brooksville, Fla.; Ralph E. Lomax, Santa Fe, N. Mex.

[73] Assignee: The Regents of the University of California Office of Technology Transfer, Alameda, Calif.

[21] Appl. No.: 626,741

[22] Filed: Apr. 2, 1996

[51] Int. Cl.[6] ..... H01B 7/08

[52] U.S. Cl. ..... 174/117 F; 174/117 FF; 174/126.1

[58] Field of Search ..... 174/117 F, 117 FF, 174/102 SP, 126.1, 255, 268

[56] References Cited

U.S. PATENT DOCUMENTS

| | | | |
|---|---|---|---|
| 2,797,393 | 6/1957 | Clogston | 333/95 X |
| 2,998,840 | 9/1961 | Davis | 428/189 X |
| 3,079,458 | 2/1963 | Hedstrom | 174/84 R X |
| 4,857,723 | 8/1989 | Modisette | 250/213 R X |
| 4,922,323 | 5/1990 | Potter | 357/71 X |
| 5,509,204 | 4/1996 | Sadigh-Behzadi | 29/883 X |
| 5,541,361 | 7/1996 | Friesen et al. | 174/34 X |

*Primary Examiner*—Kristine L. Kincaid
*Assistant Examiner*—Chau N. Nguyen
*Attorney, Agent, or Firm*—Milton D. Wyrick

[57] ABSTRACT

An electrical cable for connecting transient voltage surge suppressers to electrical power panels. A strip of electrically conductive foil defines a longitudinal axis, with a length of an electrical conductor electrically attached to the metallic foil along the longitudinal axis. The strip of electrically conductive foil and the length of an electrical conductor are covered by an insulating material. For impedance matching purposes, triangular sections can be removed from the ends of the electrically conductive foil at the time of installation.

5 Claims, 3 Drawing Sheets

HIGH CONDUCTANCE SURGE CABLE

This invention was made with Government support under Contract No. W-7405-ENG-36, awarded by the U.S. Department of Energy. The Government has certain rights in the invention.

FIELD OF THE INVENTION

The present invention generally relates to electrical cables, and, more specifically to large, high conductance cables for carrying large electrical currents.

The use of delicate electronic in most all buildings, from homes to offices and industrial sites, has made the suppression of electrical power surges an economic necessity. This is due principally to the explosive spread of computers into every area of life, as well as sophisticated telephone systems and other sensitive electronic equipment. In office and industrial buildings, one of the primary methods of reducing the danger of power surges is the installation of transient voltage surge suppressors (TVSS) in the structures' main electrical power panels. Each TVSS, in order to be effective, must have its sensing lead connected to a secure ground connection so that it can identify its ground and determine the voltage at which it will operate.

Electrical power panels are installed in virtually every building, and a large percentage have electrical TVSSs installed. The problem with most of these TVSS applications is that the distance from the nearest secure ground and/or neutral connection in the power panel to the TVSS is relatively long. The use of long grounding wires can result in increased impedance to ground, causing increasing voltages which are potentially damaging voltages to be let through the power panel, past the TVSS, to the circuits serviced by the power panel.

Testing by one company has demonstrated that these let through voltages caused by long ground sensing wires can be substantial. In one test, an Innovative Technology SP-3 surge suppressor exhibited a let through voltage of 650 V, line to ground, with a 1 foot sensing ground wire, and 1,710 V, line to ground, with a 5 foot sensing ground wire.

An interesting factor in electrical surges is that, although they occur on 60 Hz electrical systems, the surges, such as those caused by lightening, will exhibit a frequency of hundreds of kilohertz. This means that a grounding and/or neutral wire will experience radio frequencies when the TVSS is absorbing a surge, potentially presenting a significant impedance to the TVSS circuit. It is this impedance which inhibits the TVSS from fully protecting the circuits served by the electrical panel, by creating large differences between the surge voltage level in the power panel and the sensed voltage levels at the TVSS device.

Tests have demonstrated that at 250 kHz, the impedance of a single wire dropped only by a factor of 4 from a No. 22 wire to a 4 inch bus bar. In another test, the impedance dropped only approximately 15% between a No. 12 wire and a No. 4 wire.

All of this makes it abundantly clear that many electrical power panels with TVSS ground and/or neutral sensing wires longer than about 6 inches, and which must follow an angular path to a ground connection, are in peril. Unfortunately, in many power panels, the TVSS does have ground sensing and/or neutral wires longer than 6 inches, and most wires are not straight, a condition leading to inductive reactance in the wire. In practical situations, it is not often that both a TVSS ground and neutral connection can be made 6 inches from the surge suppresser and in a straight path.

It is therefore an object of the present invention to provide cable for connecting surge suppressers to ground and neutral connections which are of very low impedance.

It is another object of the present invention to provide cable for connecting surge suppressers to a ground and/or neutral connection which can be installed in situations in which the path to a ground and/or neutral connection is several feet long and not in a straight line.

Additional objects, advantages and novel features of the invention will be set forth in part in the description which follows, and in part will become apparent to those skilled in the art, upon examination of the following or may be learned by practice of the invention. The objects and advantages of the invention may be realized and attained by means of the instrumentality's and combinations particularly pointed out in the appended claims.

SUMMARY OF THE INVENTION

To achieve the foregoing and other objects, a high conductance surge cable for connecting TVSSs to electrical power panels comprises a strip of electrically conductive foil defining a longitudinal axis and a length of electrical conductor is electrically attached to the strip of electrically conductive foil at predetermined intervals along its longitudinal axis. An insulating material covers the strip of electrically conductive foil and the length of electrical conductor.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

The present invention provides cable for connecting electrical surge suppressers associated with electrical power panels to a ground and/or neutral connection. The cable minimizes the voltage which could be let through (the let through voltage) the power panel past the surge suppresser to the load equipment connected to the power panel. The invention can be best understood through reference to the drawings.

Figure 1:
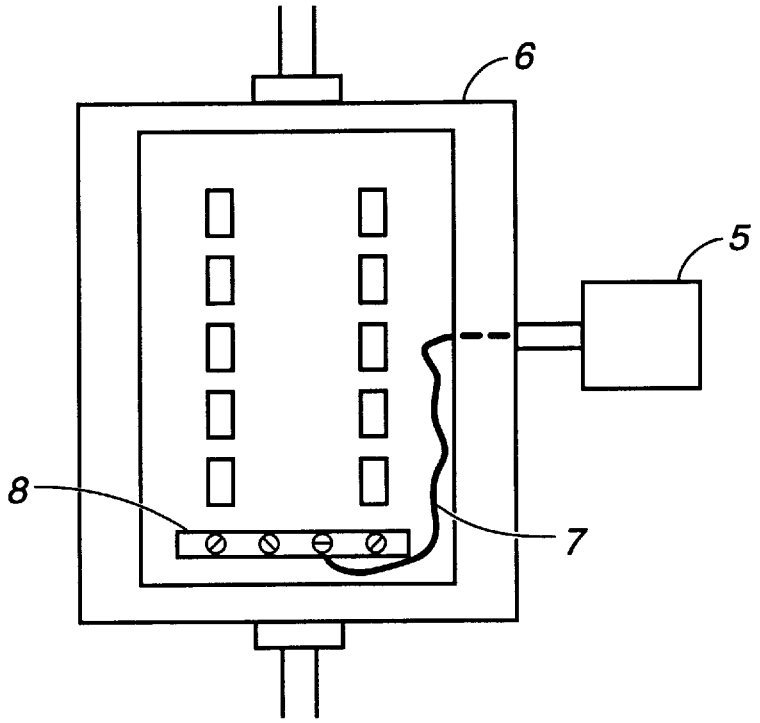
FIG. 1 is a schematic drawing illustrating the location and ground wiring of a typical TVSS installed into an electrical power panel.

FIG. 1 schematically illustrates the position of a TVSS 5 installed on an electrical power panel 6. TVSS 5 also could be installed within power panel 6. TVSS 5 has a sensing ground connection 7 extending from it to the ground bus 8 in electrical power panel 6. As shown, sensing ground connection 7 often has to traverse a considerable distance to reach a typical ground bus 8. It is this often long and circuitous route of sensing ground connection 7 which can lead to dangerously high let through voltages to circuits served by electrical power panel 6.

The position of TVSS 5 on or within electrical panel 6 can be very important. If installed at the top position, it can respond quickly to surges coming into electrical power panel 6, and to surges on nearby circuits. However, surges on the lower circuits might not be suppressed before the surge voltage has reached a damaging level. The same would be true for TVSS 5 being installed near the bottom of power panel 6. Often, a compromise is reached, and TVSS 5 is installed as shown at a middle position.

Figure 2:
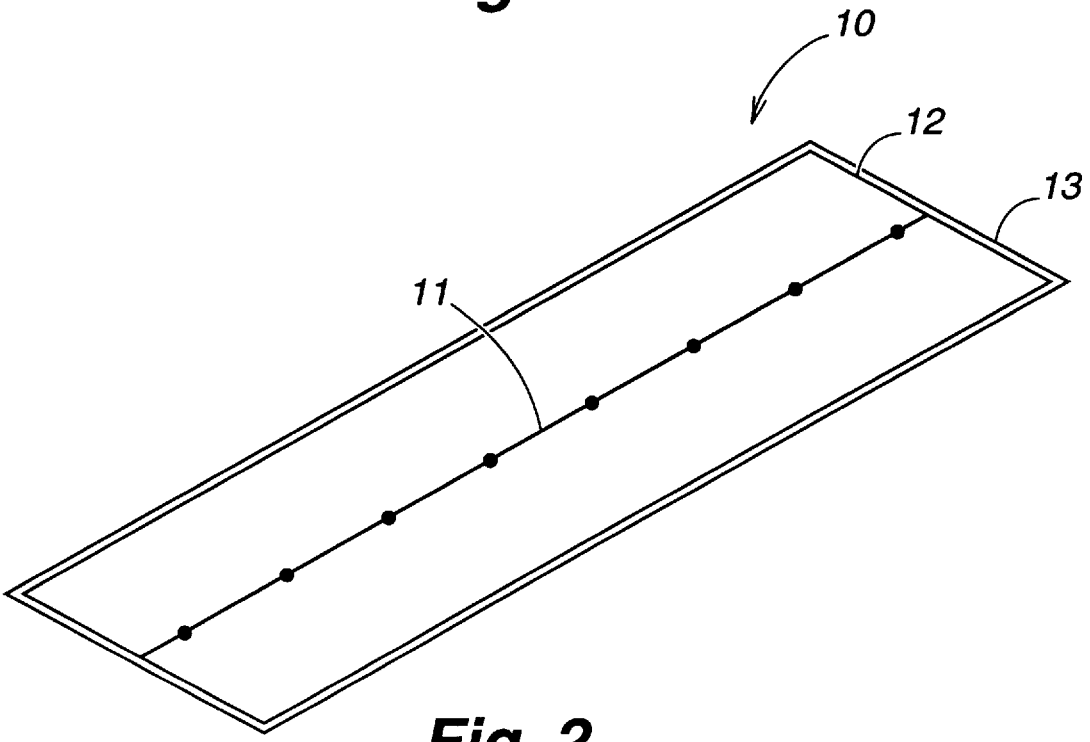
FIG. 2 is a perspective view of one embodiment of the invention illustrating the wire electrically attached along the axis of a metallic foil.

In FIG. 2, a perspective view of one embodiment of the electrical cable 10 according to the present invention is illustrated. As shown, wire 11 is electrically attached at intervals along metallic foil 12 which can comprise any suitable electrical conductor. In one embodiment, metallic foil 12 is copper, approximately 6½ inches wide, and wire 11 is bare, No. 12 copper wire. If desired, metallic foil 12 could also be aluminum. The intervals at which wire 11 is electrically attached to metallic foil 12 is not critical, but should not be any longer than six (6) inches. Any desired electrical connection of wire 11 to metallic foil 12, such as by brazing or soldering, is acceptable.

Electrical cable 10 is wrapped in an insulative wrap, 13 such as a polyethylene. This is both for protection of metallic foil 12 and wire 11, and to avoid shorting problems inside of electrical power panel 6 (FIG. 1). Any other insulating material could also be used as long as it is approved by the Underwriting Laboratories.

Figure 3:
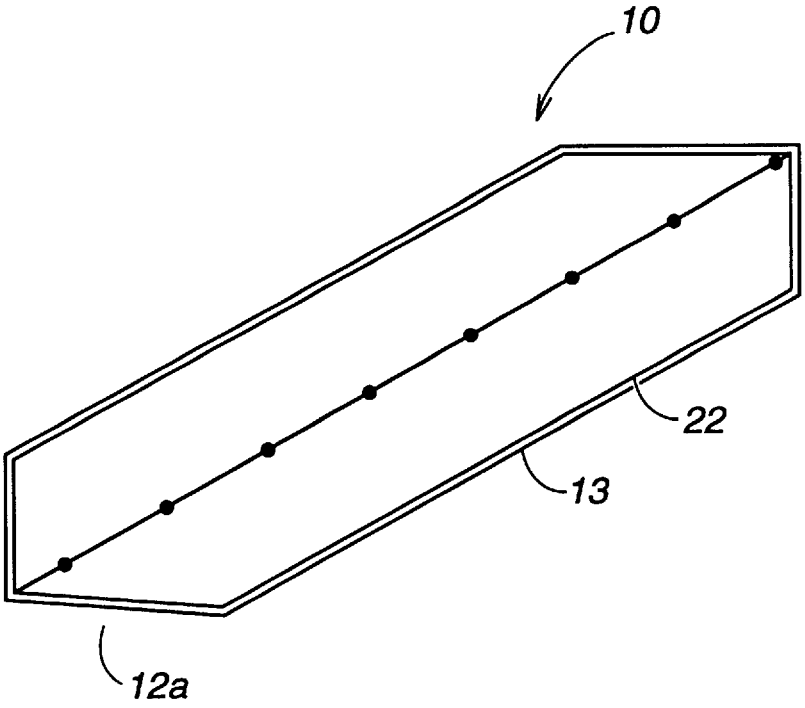
FIG. 3 is a perspective view of yet another embodiment of the present invention in which the metallic foil has triangular sections removed from each corner to match the impedance of the cable to the impedance of the power panel and TVSS.

In another embodiment of the invention, shown in FIG. 3, there is a perspective view of the cable of FIG. 2, illustrating electrical cable 10 having triangular sections 12*a* removed from each comer of metallic foil 22. The removal of triangular sections 12*a* facilitates impedance matching of electrical cable 10 to both TVSS 5 and to ground bus 8 of FIG. 1, to minimize possible reflections caused by a mismatch.

It is anticipated that cable 10 according to the present invention would be sold in reels containing a certain length of cable 10. In this case, a length of cable 10 would be cut off, and insulative wrap 13 cut back to expose wire 11. At this time, triangular sections 12*a* would be cut from metallic foil 12 prior to installation of cable 10 if impedance matching is desired. Also, if at all possible, cable 10 should be routed in close proximity to a grounded surface of the electrical power panel 6. This allows some of the surge energy in cable 10 to be capacitively coupled to ground.

Figure 4:
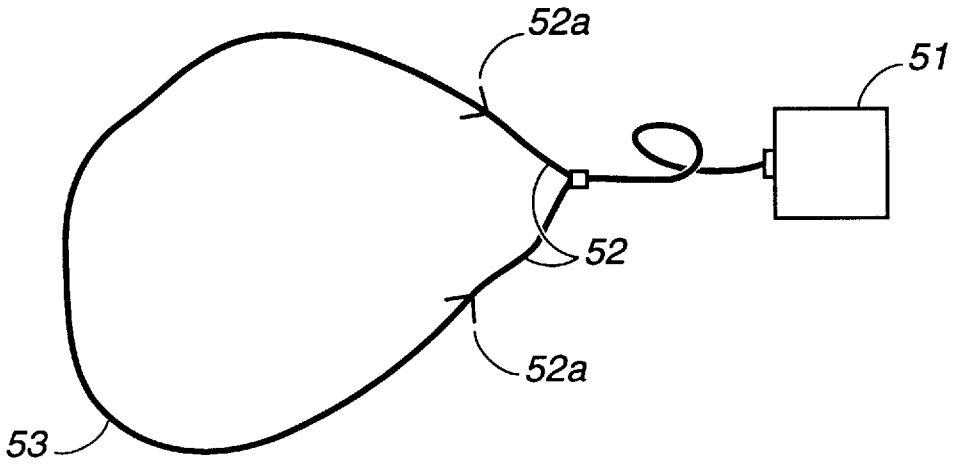
FIG. 4 is a schematic indicating the test set-up for testing embodiments of the present invention along with numerous other wires and cables for inductance, resistance, capacitance and reactance.

Testing of electrical cable 10 has verified the capabilities of cable 10 to limit let through voltages. This testing involved testing numerous one (1) meter long cables and wires along with embodiments of the present invention. The test arrangement is illustrated in FIG. 4, where meter 51 was a HEWLETT-PACKARD® HP 4284A LCR (inductance, capacitance and resistance) meter with HP 16048C leads 52. Test leads 52 are terminated in alligator clips 52*a*. Test cable 53 is connected to alligator clips 52*a*. For the testing, meter 51 was set at the 10 ma auto level. The results of the testing are shown in the following tables with the cable 10 according to the present invention designated as "6½" FOIL:"

TABLE I (@ 100 kHz)

| TEST CABLE | $L_S$ (μH) | $R_S$ (mΩ) | $C_S$ (μF) | X (Ω) |
|---|---|---|---|---|
| #20 | 1.75 | 45 | −1.45 | 1.1 |
| #12 | 1.48 | 20 | −1.72 | 0.928 |
| #6 | 1.40 | 15 | −1.81 | 0.881 |
| #2 | 1.33 | 11 | −1.90 | 0.836 |
| ½" BRAID | 1.28 | 10 | −1.98 | 0.805 |
| #4/0 | 1.20 | 11 | −2.11 | 0.754 |
| 1½" BRAID | 1.11 | 10 | −2.29 | 0.739 |
| 6½" FOIL | 0.979 | 13 | −2.59 | 0.615 |
| SHORTED LEADS | 0.621 | 59 | — | 0.400 |

TABLE II (@ 250 kHz)

| TEST CABLE | $L_S$ (μH) | $R_S$ (mΩ) | $C_S$ (μF) | X (Ω) |
|---|---|---|---|---|
| #20 | 1.73 | 65 | −234 | 2.72 |
| #12 | 1.47 | 33 | −276 | 2.30 |
| #6 | 1.39 | 26 | −291 | 2.19 |
| #2 | 1.33 | 21 | −306 | 2.08 |
| ½" BRAID | 1.28 | 15 | −317 | 2.01 |
| #4/0 | 1.19 | 22 | −340 | 1.87 |
| 1½" BRAID | 1.10 | 17 | −346 | 1.84 |
| 6½" FOIL | 0.974 | 17 | −416 | 1.53 |
| SHORTED LEADS | 0.54 | 40 | — | 0.85 |

TABLE III (@ 500 kHz)

| TEST CABLE | $L_S$ (μH) | $R_S$ (mΩ) | X (Ω) |
|---|---|---|---|
| #20 | 1.73 | 93 | 5.44 |
| #12 | 1.52 | 49 | 4.76 |
| #6 | 1.43 | 43 | 4.48 |
| #2 | 1.35 | 44 | 4.25 |
| ½" BRAID | 1.20 | 25 | 3.76 |
| #4/0 | 1.18 | 37 | 3.82 |
| 1½" BRAID | 1.14 | 30 | 3.59 |
| 6½" FOIL | 0.973 | 24 | 3.06 |
| SHORTED LEADS | 0.540 | 45 | 1.69 |

TABLE IV (@ 1 MHz)

| TEST CABLE | $L_S$ (μH) | $R_S$ (mΩ) | X (Ω) |
|---|---|---|---|
| #20 | 1.82 | 131 | 11.42 |
| #12 | 1.61 | 60 | 10.11 |
| #6 | 1.52 | 59 | 9.54 |
| #2 | 1.44 | 65 | 9.07 |
| ½" BRAID | 1.29 | 32 | 8.13 |
| #4/0 | 1.31 | 47 | 8.22 |
| 1½" BRAID | 1.24 | 40 | 7.70 |
| 6½" FOIL | 1.07 | 23 | 6.70 |
| SHORTED LEADS | 0.63 | 38 | 3.95 |

In further testing, the automatic level control of meter 52 was turned off, and the level was set at 5 mV. This testing is shown below:

TABLE V

| TEST CABLE | (@ 100 kHz) $L_S$ (μH) | $R_S$ (mΩ) | X (Ω) |
|---|---|---|---|
| #20 | 1.65 | 40 | 1.04 |
| #12 | 1.41 | 19 | 0.890 |
| #6 | 1.30 | 8 | 0.820 |
| #2 | 1.27 | 3 | 0.801 |
| ½" BRAID | 1.22 | 4 | 0.760 |
| #4/0 | 1.15 | 4 | 0.722 |
| 1½" BRAID | 1.05 | 5 | 0.665 |
| 6½" FOIL | 0.88 | 6 | 0.540 |
| SHORTED LEADS | ~0 | ~0 | ~0 |

TABLE VI

| TEST CABLE | (@ 250 kHz) $L_S$ (μH) | $R_S$ (mΩ) | X (Ω) |
|---|---|---|---|
| #20 | 1.69 | 49 | 2.67 |
| #12 | 1.45 | 20 | 2.28 |
| #6 | 1.38 | 15 | 2.10 |
| #2 | 1.31 | 5 | 2.06 |
| ½" BRAID | 1.27 | 3 | 1.98 |
| #4/0 | 1.19 | 5 | 1.87 |
| 1½" BRAID | 1.09 | 3 | 1.72 |
| 6½" FOIL | 0.098 | 10 | 1.42 |
| SHORTED LEADS | ~0 | ~0 | ~0 |

TABLE VII

| TEST CABLE | (@ 1 MHz) $L_S$ (μH) | $R_S$ (mΩ) | X (Ω) |
|---|---|---|---|
| #20 | 1.75 | 120 | 11.00 |
| #12 | 1.52 | 54 | 9.55 |
| #6 | 1.40 | 44 | 8.82 |
| #2 | 1.38 | 54 | 8.65 |
| ½" BRAID | 1.32 | 30 | 8.34 |
| #4/0 | 1.26 | 38 | 7.90 |
| 1½" BRAID | 1.16 | 35 | 7.23 |
| 6½" FOIL | 0.99 | 14 | 6.13 |
| SHORTED LEADS | 0.070 | −2 | 0.5 |

Figure 5:
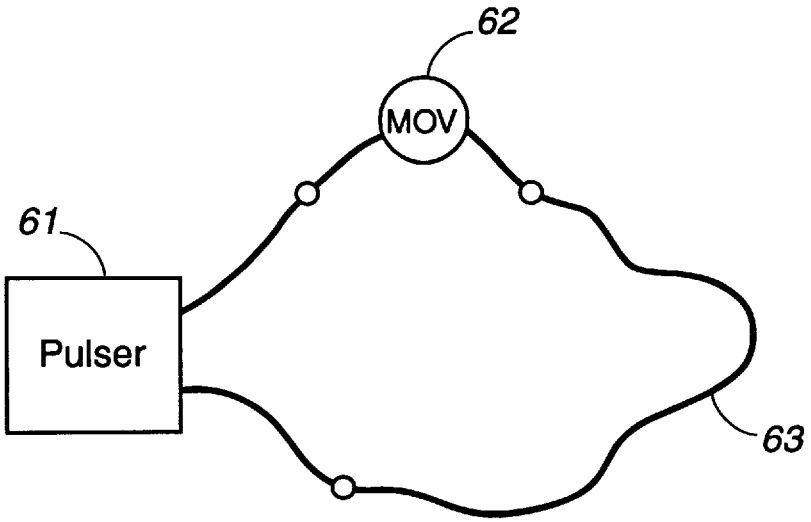
FIG. 5 is a schematic indicating the test set-up for testing embodiments of the present invention along with numerous other wires and cables for let through voltages.

Further testing of let through voltages with the various wires and cables using the test arrangement illustrated in FIG. 5. Here, pulser 61 has one output connected to MOV (Metal Oxide Varistor) 62 and its other output connected to the wire or cable 63 to be tested. The other end of one (1) meter long wire or cable 63 also is connected to MOV 62. The testing was conducted using a let through of MOV 62 of 486 V, and is shown in Table VIII.

TABLE VIII

| TEST CABLE | LET THOUGH VOLTAGE (V) |
|---|---|
| #20 | 1117 |
| #12 | 1051 |
| #6 | 964 |
| #2 | 901 |
| #4/0 | 830 |
| ½" BRAID | 883 |
| 1½" BRAID | 796 |
| 6" FOIL | 742 |

Many commercial TVSSs use either #6 or #12 wire. Table VIII clearly illustrates the improvement of the present invention over those two sizes of wire.

Figure 6:
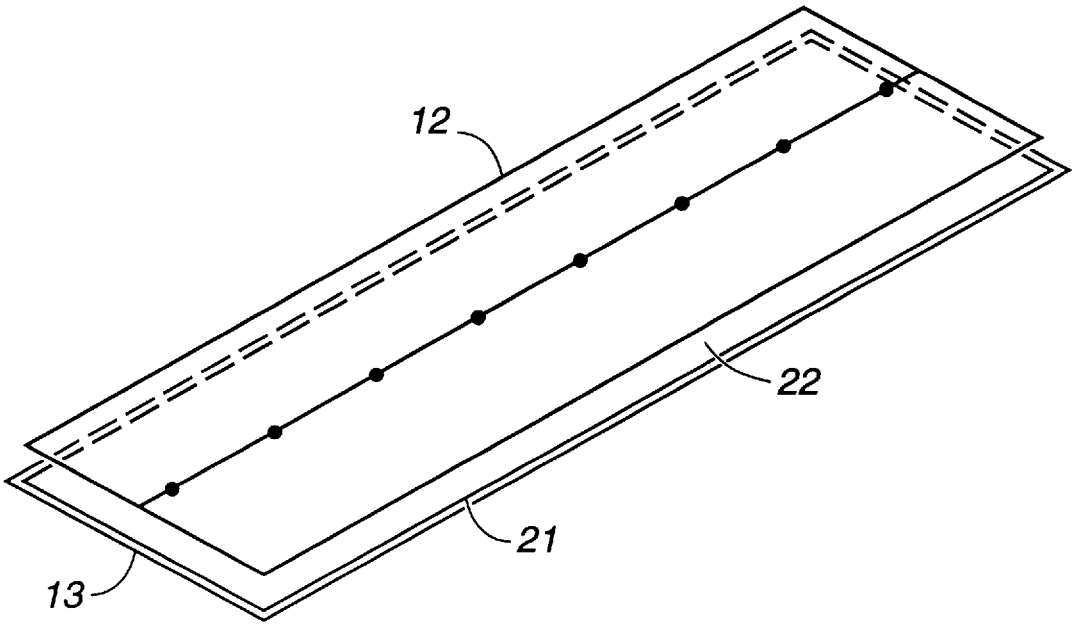
FIG. 6 is a perspective view of another embodiment of the invention illustrating a second metallic foil insulated from the original foil but connected to it at its termination.

Yet another embodiment of electrical cable 10 is illustrated in FIG. 6 which is intended to provide an even lower impedance. Here, additional layer of metallic foil 21 is placed adjacent to metallic foil 12, separated from it by dielectric layer 22. Dielectric layer 22 may comprise any dielectric such as MYLAR® (polyester film). This additional layer of metallic foil 21 acts as a ground plane when one end is connected to a ground bus. The proximity of additional layer of metallic foil 21 allows capacitive coupling of surge energy from metallic foil 12 to additional layer of metallic foil 21 in those applications in which it is impractical to run cable 10 in near proximity to the grounded surfaces of electrical power panel 6 (FIG. 1) as previously discussed.

Cable 10 also can be applied as phase conductors in large electrical control panels. For example, cable 10 can be used to connect the phase wires in motor control panels or switchboards, where TVSS 5 (FIG. 1) cannot be located within 6–12 inches of a circuit breaker.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A high conductance surge cable for connecting TVSSs to electrical power panels comprising:

a first strip of electrically conductive foil defining a longitudinal axis;

a length of No. 12 wire electrically attached to said strip of electrically conductive foil along said longitudinal axis; and an insulating material covering said strip of electrically conductive foil and said length of No. 12 wire.

2. A high conductance surge cable for connecting TVSSs to electrical power panels comprising:

a strip of electrically conductive foil defining a longitudinal axis;

a length of No. 10 wire attached to said strip of electrically conductive foil along said longitudinal axis; and an insulating material covering said strip of electrically conductive foil and said length of No. 10 wire.

3. A high conductance surge cable for connecting TVSSs to electrical power panels comprising:

a strip of electrically conductive foil defining a longitudinal axis, said strip of electrically conductive foil having a triangular section removed from each corner for impedance matching;

a length of electrical conductor electrically attached to said strip of electrically conductive foil along said longitudinal axis; and an insulating material covering said strip of electrically conductive foil and said length of electrical conductor.

4. A high conductance surge cable for connecting TVSSs to electrical power panels comprising:

a first strip of electrically conductive foil defining a longitudinal axis;

a length of electrical conductor electrically attached to said first strip of electrically conductive foil along said longitudinal axis;

a second strip of electrically conductive foil overlying said first strip of electrically conductive foil and separated from said first strip of electrically conductive foil by a dielectric material, said second strip of electrically conductive foil providing a ground plane for said first strip of electrically conductive foil when said second strip of electrically conductive foil is grounded; and an insulating material covering said second strip of electrically conductive foil, said first strip of electrically conductive foil, and said length of electrical conductor.

5. The high conductance surge cable as described in claim 4, wherein said dielectric material comprises a polyester film.

* * * * *